United States Patent [19]

Undin

[11] Patent Number: 4,825,735

[45] Date of Patent: May 2, 1989

[54] PLIERS-TYPE TOOL

[75] Inventor: Hans Undin, Akersberga, Sweden

[73] Assignee: C. A. Weidmuller GmbH & Co., Detmold, Fed. Rep. of Germany

[21] Appl. No.: 203,897

[22] Filed: Jun. 8, 1988

[30] Foreign Application Priority Data

Jun. 16, 1987 [SE] Sweden ..... 8702499

[51] Int. Cl.[4] ..... B25B 7/12

[52] U.S. Cl. ..... 81/352; 81/313; 72/409

[58] Field of Search ..... 81/313, 352–354; 72/409, 410

[56] References Cited

U.S. PATENT DOCUMENTS

| | | | |
|---|---|---|---|
| 3,157,075 | 11/1964 | Filia | 81/313 |
| 4,283,933 | 8/1981 | Wiener | 72/409 |
| 4,381,661 | 5/1983 | Wiener et al. | 72/409 |
| 4,403,497 | 9/1983 | Matteucci | 72/409 |
| 4,602,535 | 7/1986 | Wiener et al. | 81/313 |

FOREIGN PATENT DOCUMENTS

| | | | |
|---|---|---|---|
| 747508 | 4/1956 | United Kingdom | 81/352 |

*Primary Examiner*—James G. Smith

*Attorney, Agent, or Firm*—Cushman, Darby & Cushman

[57] ABSTRACT

A pliers-type tool with two handles has a parallel mechanism carrying two carrier members for working jaws. The mechanism comprises two cross-wise arranged guide lever means and one of the carrier members or one of the guide lever means is merged with one of the handles to a rigid tool body. A resilient member may be interposed, also in tools not having a parallel mechanism, between a link connecting the two handles and a counter-element in order to compensate for inaccuracies and/or to enable an extra push at the end of a closing movement of the handles.

16 Claims, 3 Drawing Sheets

Fig. 2
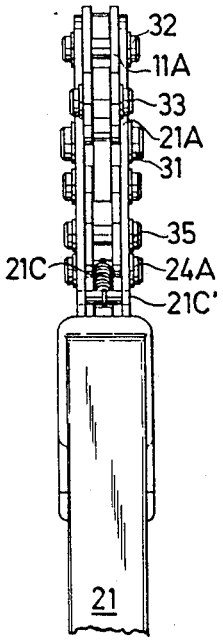
Fig. 1
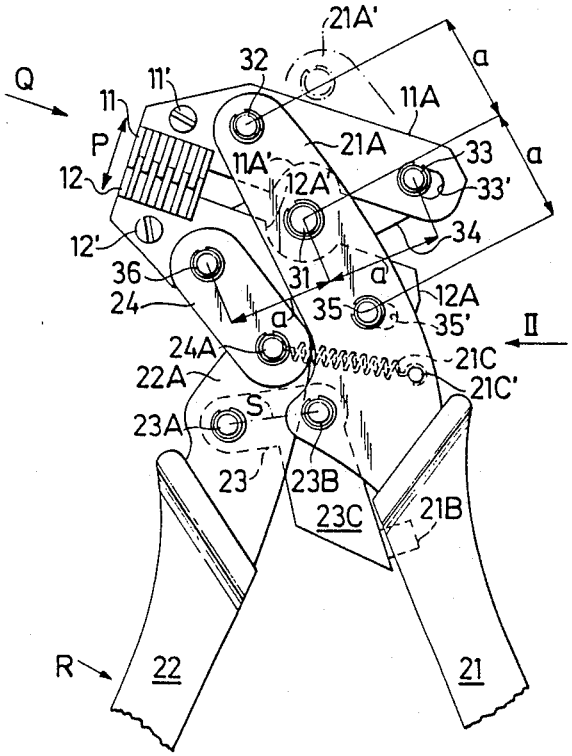
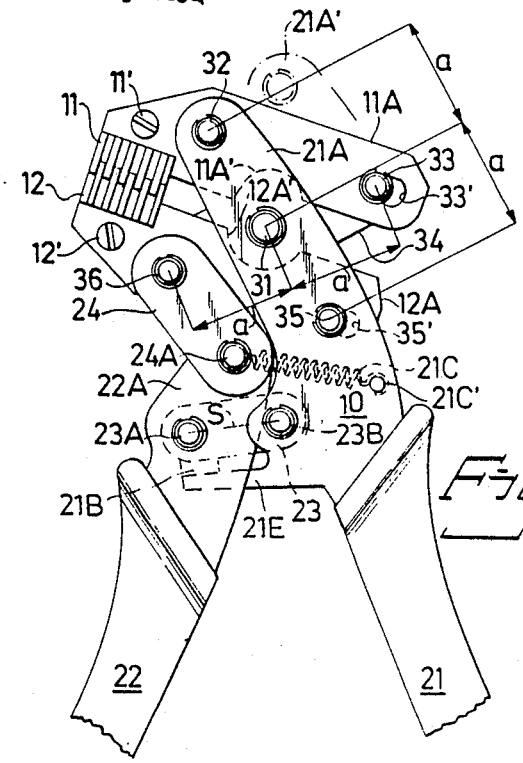
Fig. 3
Fig. 4
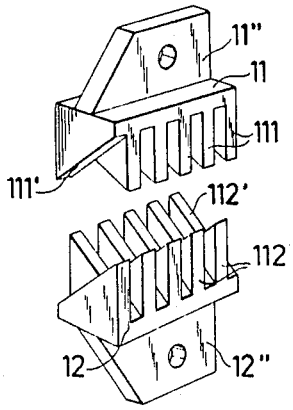

PLIERS-TYPE TOOL

BACKGROUND OF THE INVENTION

The present invention relates to a pliers-type tool with two handles which are operatively connected with two carrier members adapted at one end to carry or to embody a working jaw. The carrier members may be mounted on a parallel mechanism for mutual approachment in a parallel disposition during a closing movement, and/or the two handles may be interconnected with the aid of a connecting link hinged to each of them.

Pliers-type tools with a parallel approach movement of the jaw carriers are used when some special circumstance makes a scissors-like pivotal movement of the jaws inappropriate, or impossible. Such a circumstance may be e.g. the use of working jaws comprising a plurality of intermeshing webs, as shown in FIG. 4, unless the jaws were oriented so that a treated object had to be inserted from the side of the tool. It is however often preferred to be able to insert a treated object into a pliers-type tool from the front end of the tool.

In any pliers-type tool there extends a force transmitting path between a location on the tool where an external operating or supporting force is applied (e.g. the part of the handles where the user grips them) and the associated jaw (where the force is transferred to an article held between the two jaws). The force transmitting path is defined by those interconnected and cooperating structural parts (inclusive of possible pivot pins) which lie between the two terminal points of the path. It is known, e.g. according to the U.S. Pat. No. 4,381,661 (henceforth referred to as "the said patent") to arrange a resilient element or member somewhere in the force transmitting path so that e.g. a greater working force may be applied to larger articles than to smaller ones.

A typical field of application of the tools for the aforesaid kind is crimping of ferrules on the ends of electrical conductors. To prevent incomplete crimping due to the jaws having been opened before they have reached their final closed position, it is customary to provide such tools with a motion completion compelling mechanism which allows opening of the jaws only after a final closed position has been reached. Such a mechanism, shown e.g. in FIG. 1 in said patent, may comprise an arcuate row of teeth and a ratchet pawl engaging therewith.

To enable compensation of possible inaccuracies in production and/or of wear effects after some time of use, one of the pivot pins, e.g. in the force transmission path, may have an eccentric central part, so that by selecting and securing an appropriate rotational position of such a pin, said inaccuracies and/or wear effects may be compensated (see FIG. 7 in said patent).

It is an object of the present invention, in a first aspect thereof, to provide a tool of the kind specified which has short constructional length and into which a treated object may be inserted from the front end, i.e. in the longitudinal direction of the carrier members.

Another object of the present invention is to provide such a tool with a motion completion compelling mechanism regardless of the presence or not of a connecting link.

Yet another object of the present invention, in a second aspect thereof, is to provide in a tool with two jaw carrier members and two handles an interposed resilient member not affecting the force transmitting path and/or filling the function to compensate for possible production inaccuracies of wear effects.

In accordance with the present invention, in a first aspect thereof, a pliers-type tool comprises, in combination, a first and a second longitudinal carrier member, each having a first end adapted to carry or to embody a working jaw, and an opposite second end, and both provided, adjacent each said end, with a mounting opening, and a parallel mechanism for carrying the said carrier members and allowing them to approach, in a closing movement, one another in parallel disposition. The parallel mechanism comprises, in a manner known per se, a first and a second guide lever means, each having a circular central mounting opening and two equidistantly therefrom spaced peripheral mounting openings, the two guide lever means being in cross-wise disposition pivotally connected one with another by a central pivot pin means in said central mounting openings. Four peripheral pivot pins means are mounted in said mounting openings in the carrier members and in said peripheral mounting openings in the guide lever means to pivotally attach the carrier members to the guide lever means, the mounting openings at the second ends of the carrier members, or the thereto adjacent peripheral mounting openings in the guide lever means, being elongated in the longitudinal direction of the carrier member to allow movement of the respective pivot pin means in said direction, all the other mounting openings being circular. The tool comprises further a first handle rigidly connected with one of the parts first guide level means, and first carrier member, to define a unit or a tool body therewith. A second handle is pivotally connected to said tool body, and via a force transmitting member is operatively connected with the second carrier member. A driving link embodies said force transmitting member and is pivotally connected to the second handle and to the second carrier member.

In accordance with a second aspect of the present invention, a pliers-type tool comprises, in combination, a first and a second carrier member, each one adapted to carry or to embody a working jaw, and to approach one the other in a closing movement and a first and a second handle, operatively connected with the first and the second carrier member respectively and approachable, in a closing movement, one to another to produce said closing movement of the carrier members, each handle having a first free end and an opposite second end for connection to the respective carrier member. A connecting link pivotally connects the first and the second handle and has a first hinge point for attachment of the first handle and a second hinge point, spaced from the first one, for attachment of the second handle and a resilient member is at a location spaced from said first hinge point interposed between the said connecting link or a part rigidly connected therewith, and is positioned and dimensioned so as to be, at least in a final phase of said closing movement of the handles, compressed by the two parts between which it is interposed.

The various features of novelty which characterize the invention are pointed out with particularity in the claims annexed to and forming part of this disclosure. For a better understanding of the invention, its operating advantages and specific objects attained by its use, reference should be made to the accompanying drawing and descriptive matter in which there are illustrated and described preferred embodiments of the invention.

BRIEF DESCRIPTION OF THE DRAWING

In the drawing:

FIG. 1 is an elevational view of a first embodiment of a tool according to the present invention;

FIG. 2 is a side view of the tool of FIG. 1;

FIG. 3 is an elevational view of a first modification of the tool of FIG. 1;

FIG. 4 is a perspective view, on a larger scale, of the working jaws of the tools of FIG. 1 and 3;

Figure 5:
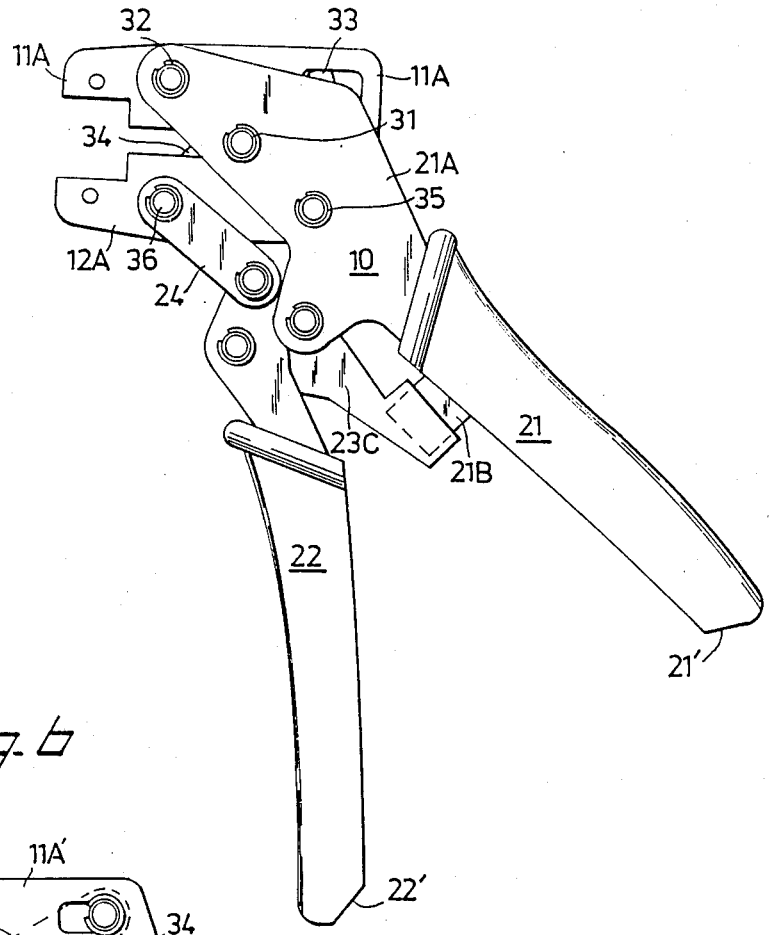
FIG. 5 is an elevational view of a second modification of the tool of FIG. 1 without jaws.

Functionally equivalent parts are in all drawing figures designated by identical or analogical reference numerals.

DETAILED DESCRIPTION OF THE INVENTION

According to FIGS. 1 and 2, a tool comprises a first handle 21 and a second handle 22, as well as a first longitudinal carrier member 11A and a second longitudinal carrier member 12A. The two carrier members 11A, 12A carry at their first ends, i.e. the left hand ends in the drawing, a rigidly but interchangeably attached working jaw 11, 12, shown in more detail in FIG. 3. It will be realised that said first ends also may be adapted or shaped so as to themselves embody the working jaws.

The two carrier members 11A, 12A are supported by a parallel mechanism which comprises a first guide lever means 21A and a second guide lever means 34 which cross one another. The first guide lever means 21A is rigidly connected, and preferably integrally manufactured with the first handle 21 to define a unit or a tool body 10 therewith. The first guide lever means 21A extends essentially in the same direction as the first handle 21, e.g. defines a straight extension thereof. Possibly, it may be somewhat sidewise shifted, as indicates in phantom lines at 21A".

The second guide lever means 34 is defined by an independent unit which is not rigidly connected to any other part. Both guide lever means 21A, 34 are provided with a circular central mounting opening and two peripheral mounting openings. The two guide lever means 21A, 34 are pivoted one to another with the aid of a central pivot pin means 31 which is immovably mounted in the central mounting openings in both said parts.

Each guide lever means is further on both sides of the central mounting opening provided with a peripheral mounting opening in which it is with the aid of peripheral pivot pins means 32, 35 and 33, 36 pivotally attached to one of the carrier members 11A, 12A. All peripheral pivot pin means lie at equal distances a from the central mounting opening.

The first carrier member 11A is at the peripheral mounting opening which lies closer to its first end, by means of the peripheral pivot pin 32, attached to the first guide lever means 21A, and at the peripheral mounting opening which lies farther apart from the first end by means of the peripheral pivot pin 33, to the second guide lever means 34.

Analogically, the second carrier means 12A is at the peripheral mounting opening which lies closer to its first end by means of the peripheral pivot pin 36 attached to the second guide lever means 34, and at the peripheral mounting opening which lies farther apart from the first end by means of the peripheral pivot pin 35 to the first guide lever means 21A.

The pivot pins 32 and 36, which are located closer to the said first ends, are in both parts which they connect, immovably mounted in circular mounting openings. The pivot pins 33, 35 which are located farther apart from said first ends, are in one of the parts they connect immovably mounted in circular mounting openings, and in the other part movably mounted in longitudinal mounting openings 33', 35' extending in the longitudinal direction of the carrier members 11A, 12A, i.e. generally in a direction at right angles to the direction P of the closing and opening movement of the two carrier members 11A, 12A.

In the embodiment shown in FIG. 1, the pivot pin 33 is mounted in a circular hole in the second guide lever means 34, and in an elongated hole 33' in the first carrier member 11A, while the pivot pin 35 is mounted in a circular hole in the first guide lever means 21A, and in an elongated hole 35' in the second carrier means 12A. It will be appreciated, however, that the described arrangement also may be reversed with one or both pivot pins.

The two carrier members 11A, 12A are at their juxtaposed edges 11A' and 12A' shaped so as to clear the central pivot pin 31 even upon closest approach.

The second handle 22 is attached to the tool body 10 with the aid of a connecting link 23 which is at its one end, in a first hinge point, pivotally attached to the first handle 21 (or to the tool body 10) by a pivot pin 23B, and at the other end, in a second hinge point, by a pivot pin 23A to the second handle 22. The second 22 is further, on an extension 22A beyond the pivot pin 23A, by means of a further pivot pin 24A attached to one end of a driving link 24 which at its other end is with the aid of the already mentioned pivot pin 36, connecting the second carrier member 12A and the second guide lever means 34, pivotally attached to the second carrier member 12A and to the second guide lever means 34. The driving link 24 defines a force transmission member between the second handle 22 and the second carrier member 12 A.

The connecting link 23 is provided with an extension or projection 23C extending toward the free ends 21', 22' (see FIG. 5) of the two handles 21, 22, substantially transversely to a line S interconnecting the two hinge points of the connecting hinge 23, i.e. the two pivot pins 23A and 23B.

In the first handle 21 there is mounted a resilient element or member defined by a cushion 21B of rubber or plastics which partly protrudes from the handle and against which the projection 23C may bear with a terminal part during the final phase of a closing movement of the second handle 22 in the sense of arrow R, thus compressing the cushion. The connecting link 23 effects during such a closing movement a limited rotational movement about the pivot pin 23B during which its opposite end (at the pivot pin 23A) is lowered toward the free ends 21', 22'. It will be noted that cushion 21B is not placed in any force transmitting path as defined above, such paths being defined in the tool of FIG. 1 by the parts 22, 22A, 24A, 24, 36, 12A and 12 on the one hand, and 21, 21A, 32 and 11A on the other hand.

A tension spring 21C operates between the pivot pin 24A and an anchoring pin 21C' to hold the tool open (i.e. with the carrier members and the handles furthest apart) when not operated by a user.

The tool according to the present invention may preferably be constructed so that at least some of its constituent or component parts are embodied by two, at a selected spacing parallel arranged side plates as is seen in FIG. 2. The second guide lever means 34 may then conveniently be embodied by a single, e.g. 2.5 mm thick steel plate, the two carrier members 11A, 12A by two steel plates of perhaps 1.5 mm thickness each, and spaced apart 2.5 mm, and the first guide lever means 21A by two perhaps 1.5 mm thick steel plates spaced 5.5 mm one from the other, the two side plates of the carrier members encompassing the second guide lever means, and the two side plates of the first guide lever means encompassing in their turn the two carrier members. Also other combinations of parts consisting of one plate and parts consisting of two plates are possible.

The pivot pins may be defined by cylindrical bodies of corresponding length (e.g. the pivot pin 32 somewhat longer than 8.5 mm), provided at both ends with a circumferential groove in which a circlip, bearing against the outer face of the respective side plate, is inserted.

The jaws 11, 12 are, as shown more in detail in FIG. 4, provided with a plurality of projecting webs 111, 112 with slanting edges 111', 112' embodying engagement surfaces. These surfaces define a rectangular reception space for a treated article, which space upon mutual approachment of the two jaws gradually diminishes. By means of rearwardly projecting lugs 11", 12", which may be inserted into the carrier members 11A, 12A (e.g. by having the same thickness as the second guide lever means 34), can the jaws 11, 12 be rigidly mounted in the carrier members 11A, 12A and secured therein by screws 11', 12' passing through appropriate holes in the lugs 112, 12". An article to be treated can then be inserted in the pair of jaws "from the front", i.e. in the sense of arrow Q. Working jaws of this kind are known e.g. from the said patent. Also working jaws of some other kind may of course be used in connection with the present invention.

The tool operates as follows. When the second handle 22 is operated in the sense of arrow R, the pivot pin 24A, overcoming the force of the spring 21C, describes a circular path centered on the pivot pin 23A which results in the driving link 24 forcing, via the pivot pin 36, the second carrier member 12A against the first carrier member 11A. At the same time, the connecting link 23 effects the above mentioned limited rotational movement about the pivot pin 23B.

The second guide lever means 34 swings the first carrier member 11A about the peripheral pivot pin 32, the other peripheral pivot pin 33 moving in the elongated hole 33' toward the outer end thereof.

At the same time, the second carrier member 12A is shifted somewhat to the left in FIG. 1, because the peripheral pivot pin 36 describes a circular path centered on the central pivot pin 31 (such a shift is enabled by the hole 35' being elongated). It will be appreciated that all these movements will also be possible if one or both elongate holes change their place with the adjacent circular holes.

After the jaws 11, 12 have approached one another to such an extent that an inserted article is firmly grasped by their engagement faces 111', 112', the second handle 22 may still be swung a little farther in the sense of arrow R, causing the connecting link 23 to swing farther about the pivot pin 23B and the terminal part of the projection 23C to compress the resilient element 21B. Thereby the same effect, in principle, is achieved as when the resilient member is interposed in the force transmitting path, although it is located out of this path which consequently has an unchangeable length.

The modified embodiment of FIG. 3 differs from the embodiment of FIG. 1 in that the resilient member 21B is interposed between the connecting link 23 proper, and a rigid projection 21E of the first handle 21 or tool body 10. It will be realized that the resilient member 21B is even then located spacedly from the first hinge point of the connecting link 23, i.e. the hinge point about which the connecting link 23 rotates toward the free ends 21', 22'.

In the alternative embodiment of FIG. 5 the resilient element 21B is affixed to the projection 23C and the respective parts are dimensioned in a manner which will be explained more in detail below.

Figure 6:
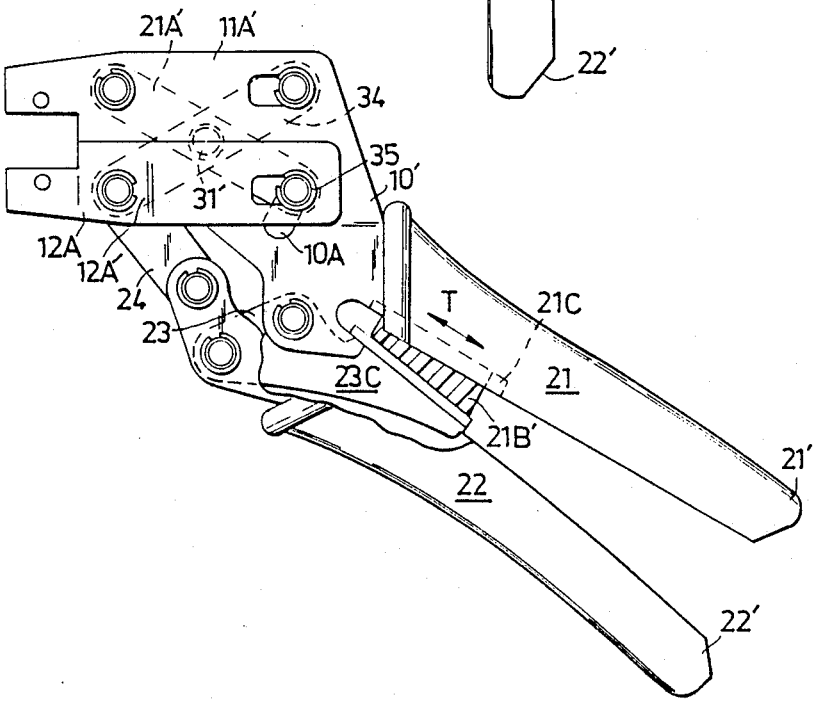
FIG. 6 is an elevational view of a second embodiment of a tool according to the invention without jaws.

In FIG. 6 is shown a second embodiment of the tool according to the present invention, which differs from the embodiment according to FIG. 1 or 3 in that the first handle 21 is merged with the first carrier 11A', and not with the first guide lever means 21A', into a rigid unit or tool body 10', the first guide lever means being embodied by an independent unit which, in analogy to the second guide lever means 34, is not rigidly connected to any other part.

Both guide lever means 21A' and 34 are located in the unit 10', one of them being embodied by a single plate, and the other one by two plates encompassing the single plate. The central pivot pin 31' terminates at the surface of the guide lever means which has the two plates.

The second carrier member 12A consists also of two side plates which are outwardly bent at 12A' so as to be able to encompass the unit 10'. In the side walls (side plates) of the unit 10' there are provided slanting elongate openings 10A which have greater width than the diameter of the pivot pin 35, so that said pin has all the necessary freedom of movement. The tool operates in the same manner as before described.

In order that a tool of the present kind may be adjusted upon assembly, and/or that differences which may arise later on due to wear might be compensated, it is customary to shape for example one of the pivot pins in said force transmitting path with an eccentric middle part, so that by changing the rotational position of this pin, a desired adjustment of the tool may be obtained.

Figure 7:
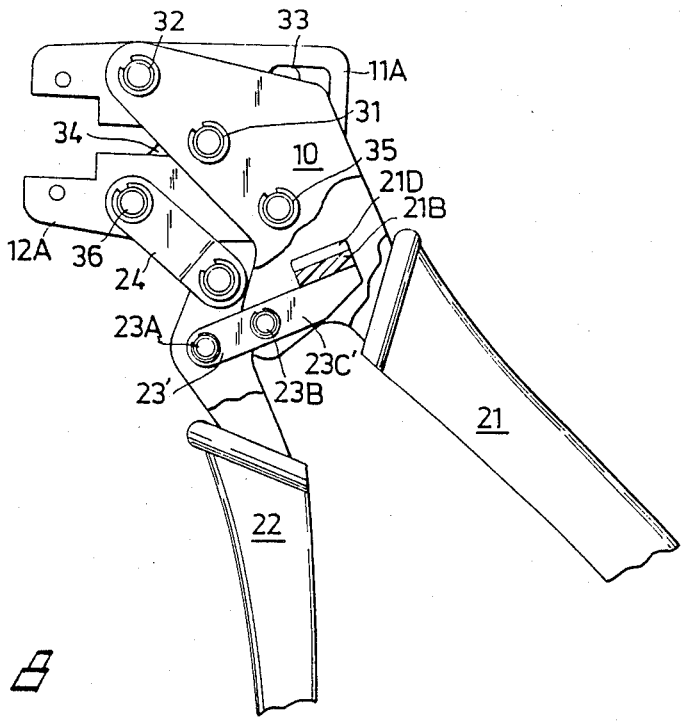
FIG. 7 is an elevational view of a third modification of the tool of FIG. 1 without jaws.
Figure 8:
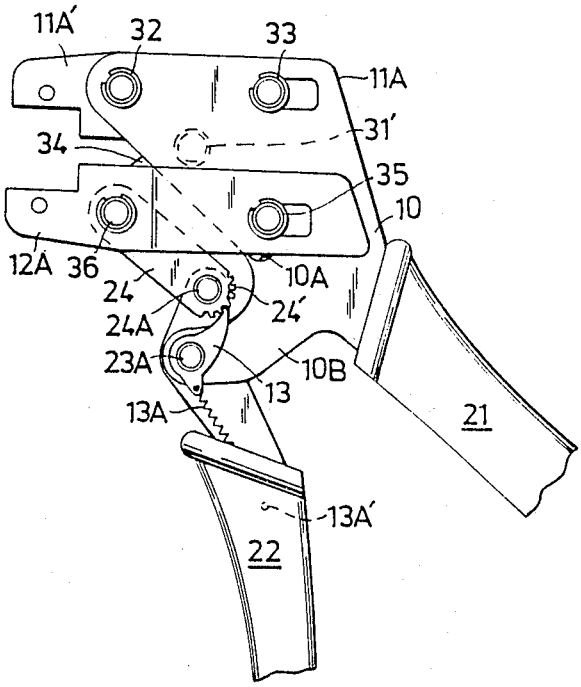
FIG. 8 is an elevational view of a modification of the tool of FIG. 6 without jaws.

A resilient element or member according to the present invention, located outside the force transmitting path, may fill the same adjustment or compensation function. To this purpose, the resilient member, its counter-element (such as the handle 21, the connecting link 23 or the projection 23C) are to be so dimensioned and shaped that the resilient member is partly compressed already in the position of the tool in which the handles are most opened, as is shown in FIGS. 5 and 7. Any inaccuracies present upon first assembly, or acquired later on, will only cause a change (in one sense of the other) of the preselected degree of initial compression of the resilient member.

It is preferable for the pressure with which the counterelement affects the resilient member to be settable (e.g. in order that the original value of the initial pressure may be reset after some time of use). This may be achieved e.g. by making the carrier and/or the counterelement of the resilient member settable as to position, e.g. in the embodiment of FIG. 1 with the aid of a setting screw or the like, affecting the resilient member 21B from behind, parallel with arrow II.

A preferred manner of arranging a settable resilient member is shown in FIG. 6. The cushion 21B' of resilient material, such as rubber or plastic, is wedge-shaped and mounted in a bed 21C which is longer than the cushion. The cushion 21B' may be moved in its bed 21C in the two senses of the double arrow T, and fixed in a selected position. With a dislocation toward the free ends 21', 22' of the handles 21, 22 the effective pressure is decreased, and with a dislocation in the opposite sense, increased. For fixing the cushion 21B in a selected position any known means may be used, e.g. a plurality of cooperating, transversely extending grooves on the bottom face of the bed 21C and on the adjacent rear face of the cushion 21B.

According to FIG. 7, the connecting link 23' is provided with a straight extension 23C' beyond the pivot pin 23B, and in the unit 10 there is provided a stop 21D defining a counterelement for a cushion 21B. The stop 21D, the cushion 12B and the projection 23C' are so dimensioned and located that they operate so as to fulfil a compensation function, the cushion 21B being partially compressed already in the maximally open position of the tool, shown in the drawing.

The cushion 21B may be affixed either to the stop 21D, or to the extension 23C', or to a possible separate carrier part; it is only essential that the cushion be interposed between the stop 21D and the extension 23C'. In any of these cases, the compensation of inaccuracies is achieved automatically by a change of the preselected compression value in one sense or the other, and in the final phase of the closing movement, a further compression of the resilient member may be possible.

It will be realised that the extension of or projection on the connecting link 23 which affects the resilient member may also extend in some other direction beyond the pivot pin 23B than what is shown in the drawings, e.g. upward in FIG. 7, as long as a stop similar to the stop 21D is provided on the respective location.

It will be further recognised that the resilient member may also be embodied by a spring, e.g. a curved leaf spring, the arrangement of the resilient member according to the present invention always preserving the previously mentioned force transmitting path "rigid" to the same extend as when no resilient member is provided.

It is further customary to provide pairs of pliers of the present kind with a motion completion compelling mechanism in order to prevent a premature discontinuation of a pressing operation. Such a mechanism may comprise an arcuate row of teeth and a spring-loaded ratchet pawl engaging therewith. The row of teeth is usually located on the connecting link or, as shown in FIG. 1 in the said patent, on a separate part rigidly attached to this link. In FIG. 7 is shown a tool according to the present invention without any connecting link, (it having been replaced by a rigid projection 10B on the unit 10, to which the second handle 22 is pivotally attached by the pivot pin 23A).

The tool is provided with a motion completion compelling mechanism of the known kind. The arcuate row of teeth 24' is located on the end of the driving link 24 which is closer to the second handle 22, and is centered about the pivot pin 24A. On the pivot pin 23A is pivotally mounted a ratchet pawl 13, engaging said row of teeth. The ratchet pawl 13 is affected by a tension spring 13A which is at its other end at 13A' anchored in the second handle 22.

What is claimed is:

1. A pliers-type tool comprising in combination:

a first and a second longitudinal carrier member, each having a first end adapted to carry or to embody a working jaw, and an opposite second end, and provided, adjacent to each said end, with a mounting opening;

a parallel mechanism for carrying the said two carrier members and allowing them to approach, in a closing movement, one another in parallel disposition, said mechanism comprising a first and a second guide lever means, each having a circular central mounting opening and two equidistantly therefrom spaced peripheral mounting openings, the two guide lever means being in cross-wise disposition pivotally connected one with another by a central pivot pin means in said central mounting openings;

four peripheral pivot pins means mounted in said mounting openings in the carrier members and said peripheral mounting openings in the guide lever means to pivotally attach the carrier members to the guide lever means, one of the mounting openings at the second ends of the carrier members, or the adjacent peripheral mounting openings in the guide lever means, being elongate in the longitudinal direction of the carrier members to allow movement of the respective pivot pin means in said direction, all the other mounting openings being circular;

a first handle rigidly connected with one of the first guide lever means or first carrier member, to define a unit or a tool body therewith;

a secong handle pivotally connected to said tool body and via a force transmitting member operatively connected with the second carrier member, and a driving link embodying said force transmitting member and pivotally connected to the second handle and to the second carrier member.

2. The tool of claim 1, wherein the first handle and the first guide lever means are merged into a tool body, and the first guide lever means part thereof extends essentially in the same direction as the handle part.

3. The tool of claim 1, wherein the second handle is connected to the tool body by means of a connecting link having a first hinge point for pivotal attachment to the tool body and a second hinge point for pivotal attachment to the second handle.

4. The tool of claim 3, wherein the second handle has an extension beyond the second hinge point and link, said driving embodying said force transmitting member, is at its one end pivoted to said extension and at the other end to the second carrier member.

5. The tool of claim 1, wherein the second handle is attached to the tool body by being pivotally attached to a projection rigidly connected with the tool body.

6. The tool of claim 5, wherein the second handle has an extension beyond the point of pivotal attachment to the said projection, and said driving, embodying transmitting link, said force member, is at one its end pivoted to said extension and at the other end to the second carrier member.

7. The tool of claim 1, comprising a motion completion compelling mechanism with an arcuate row of teeth and a spring-loaded ratchet pawl engaging therewith, wherein the said row of teeth is arranged on the driving link, centered about the point of pivotal attachment of the driving link to the second handle.

8. The tool of claim 1, wherein at least some constitutional parts: carrier members, guide lever means, tool body, second handle and driving link are embodied by two spacedly arranged side plates.

9. A pliers-type tool, comprising in combination a first and a second carrier member, each one adapted to carry or to embody a working jaw, and to approach one the other in a closing movement, a first and a second handle, operatively connected with the first and the second carrier member respectively and approachable, in a closing movement, one to another to produce said closing movement of the carrier members, each handle having a first free end and an opposite second end for connection to the respective carrier member;

a connecting link for pivotally connecting the first and the second handle and having a first hinge point for attachment of the first handle and a second hinge point, spaced from the first one, for attachment of the second handle, the connecting link rotating, at least in the final phase of said closing movement, about the first hinge point;

a resilient member which at a location spaced from the said first hinge point is interposed between (1) the said connecting link or a part rigidly connected therewith, and (2) the first handle or a part rigidly connected therewith and which is positioned and dimensioned so as to be, at least in a final phase of said closing movement of the handles, compressed by the two parts between which it is interposed.

10. The tool of claim 9, wherein the resilient member is interposed between the first handle and a projection on the connecting link extending toward the said free ends of the handles in a direction transverse to a line connecting the two hinge points.

11. The tool of claim 9, wherein the resilient member is interposed between a stop rigidly connected with the first handle and a straight extension of the connecting link extending on the opposite side of the first hinge point then where the second hinge point is located.

12. The tool of claim 9, wherein the resilient member is interposed between the connecting link and a rigid projection extending from the said second end of the first handle toward the second handle.

13. The tool of claim 9, wherein the resilient member is affixed to and carried by one of the two parts between which it is interposed.

14. The tool of claim 9, wherein the resilient member is settable in a plurality of selected positions.

15. The tool of claim 14, wherein the resilient member is wedge-shaped.

16. The tool of claim 9, wherein the resilient member is to a preselected extend compressed already in the most open position of the handles.

* * * * *